US005419051A

United States Patent [19]

Barngrover

[11] Patent Number: 5,419,051

[45] Date of Patent: May 30, 1995

[54] BOWSIGHT

[76] Inventor: Russell H. Barngrover, 25267 Basel Dr., Crestline, Calif. 92325

[21] Appl. No.: 266,248

[22] Filed: Jun. 27, 1994

[51] Int. Cl.[6] ..... F41G 1/467

[52] U.S. Cl. ..... 33/265; 124/87

[58] Field of Search ..... 33/265; 124/87

[56] References Cited

U.S. PATENT DOCUMENTS

| | | | |
|---|---|---|---|
| 2,654,152 | 10/1953 | La Vire | 33/265 |
| 3,670,422 | 6/1972 | Stebbins et al. | 33/265 |
| 5,174,269 | 12/1992 | Sappington | 33/265 |
| 5,220,907 | 6/1993 | Longsdale | 33/265 |
| 5,228,204 | 7/1993 | Khoshnood | 33/265 |

*Primary Examiner*—Christopher W. Fulton

*Attorney, Agent, or Firm*—Edgar W. Averill, Jr.

[57] ABSTRACT

A bowsight for attachment to a bow. The bowsight has a crosswire frame which is supported by a bracket held to the bow. A pin slide is formed in an inner frame member and has a cylindrical opening. The pins are held on discs which slide into the cylindrical opening and which are tightened by an Allen screw against a slot in the disc, thereby expanding the disc against the side of the pin slot. The crosswire frame may be incrementally moved up and down with respect to the bracket by a series of detents in the frame and a spring loaded ball in the bracket. The spring loaded ball may be tightened so that the spring is completely compressed thereby locking the ball in a chosen detent.

10 Claims, 3 Drawing Sheets

12
10
20
29
16
38
25
3
23
6
21
11
27
22
3
19
27'
6
14
13
17
28
30
18

39
29
11
17
38
31
18
23
32
13
49
23
41
24
35
15
14
37

BOWSIGHT

BACKGROUND OF THE INVENTION

The field of the invention is archery and the invention relates more particularly to bowsights for improving the aim of the archer.

Bowsights are well known and numerous patents have been granted therefor. One such bowsight is shown in the Topel U.S. Pat. No. 4,136,462 which has a plurality of adjustable pins in a bowsight frame. This bowsight has a number of knurled knobs that extend outwardly therefrom which potentially can catch on underbrush and the like and therefore a more compact and streamlined sight would be useful.

SUMMARY OF THE INVENTION

It is an object of the present invention to provide a compact bowsight with adjustable bowsight pins which bowsight can be adjusted upwardly and downwardly in discrete increments and yet may be locked in a desired position.

The present invention is for a bowsight for attachment to a bow. The bowsight has a bracket which is affixed to the bow and a reticle support frame held by the bracket. The support frame has an inner vertical member and a pin slide is formed in the inner frame member. The pin slide is a cylindrical opening which extends vertically from the bottom of the inner frame member to near the top thereof and an elongated pin slot extends toward the center of the sight. An Allen screw access slot is formed in the rear of the sight and intersects the cylindrical opening. A plurality of sliding pin block discs are held in the pin slide. Each pin block disc has a bowsight pin extending outwardly therefrom into the central area of the bowsight. Each pin block disc has an Allen screw opening which can be accessed with an Allen screw through the Allen screw access sight. Each pin block disc has a threaded Allen screw opening which extends to an expansion slot so that the tightening of the Allen screw expands the circumferential size of a pin block disc securing it against the cylindrical opening in the inner member. The securement is such that it does not in any way mar the vertical cylindrical openings so that small adjustments may be made in the height of each pin block disc. The reticle support frame is preferably held to the bracket by a dovetail slide attachment which has a plurality of detents formed in the center of the dovetail connection on the inner frame member. A bracket cross piece has a threaded opening ending in a spring and ball containing opening and the ball may be tightened against the detents. The size of the spring is selected so that when the threaded rod in the bracket cross piece is fully tightened the spring is fully compressed and, therefore, holds the ball bearing in a selected detent preventing any movement. The sight may be set up as a pin setup or as a crosshair setup with either pins or wires held by the sliding pin block discs.

DESCRIPTION OF THE PREFERRED EMBODIMENTS

Figure 1:
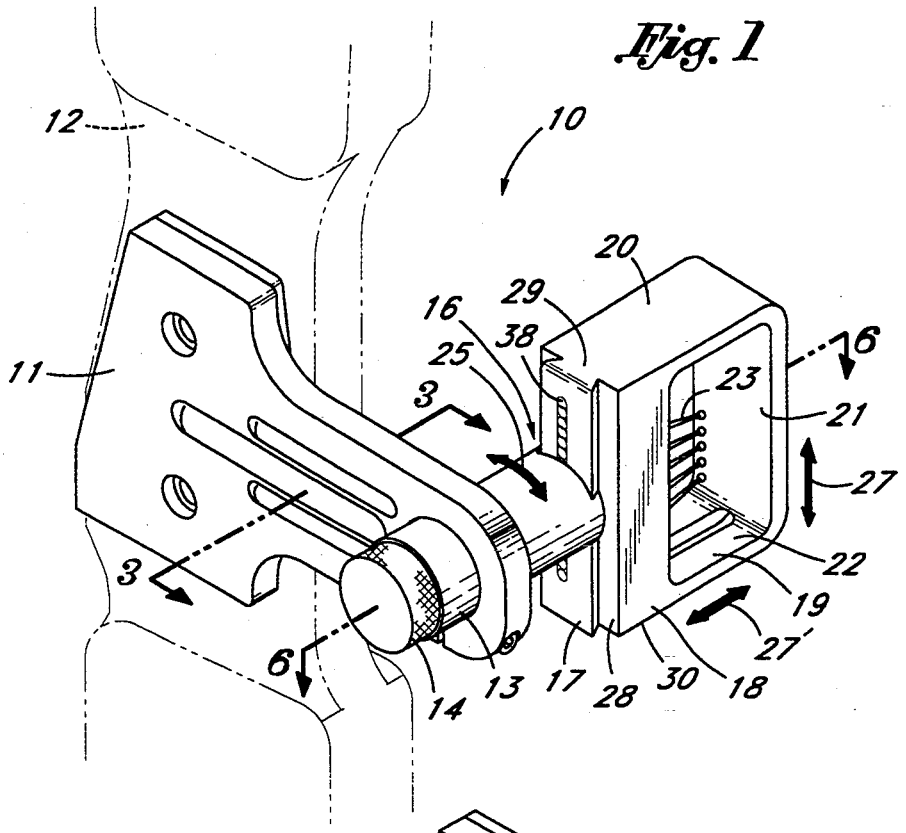
FIG. 1 is a perspective view of the bowsight of the present invention attached to a portion of a bow shown in phantom view.

FIG. 1 shows the bowsight of the present invention indicated generally by reference character 10. Bowsight 10 has a bracket which is made up of a bracket member 11 affixed to a bow 12 shown in phantom view. A bracket cross piece 13 is adjustably affixed to bracket member 11 and includes a knurled knob 14 affixed to a threaded rod 15 (see FIG. 2) to secure the bowsight assembly in a desired position. The means of securement will be described below.

Figure 3:
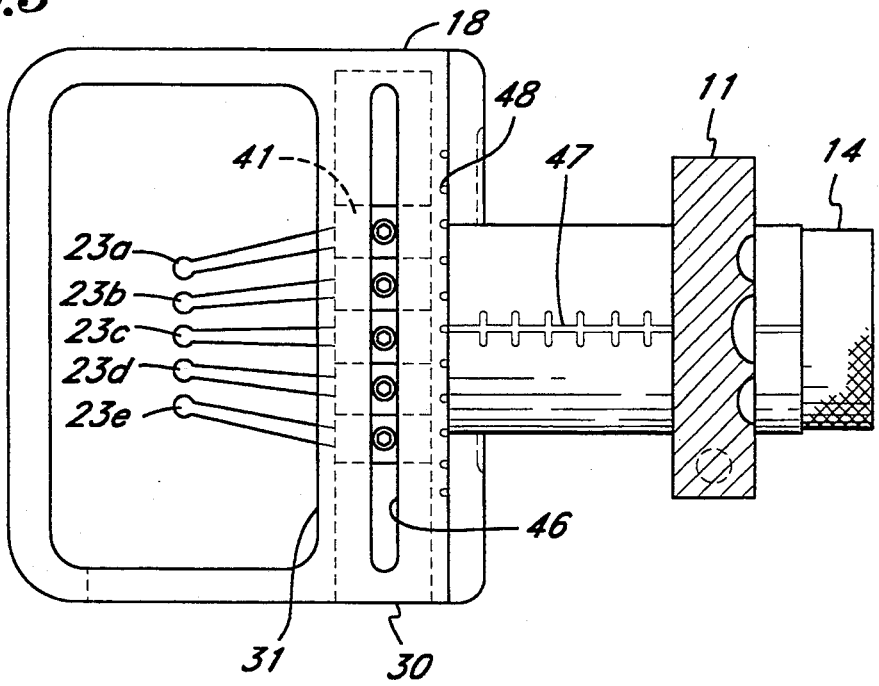
FIG. 3 is a view partially in cross section taken along line 3—3 of FIG. 1 showing the bowsight as a pin setup.
Figure 4:
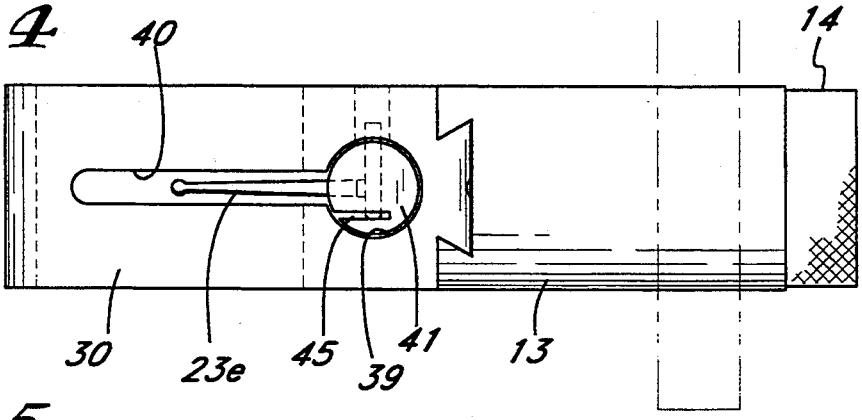
FIG. 4 is a top view of the bowsight of FIG. 1.
Figure 5:
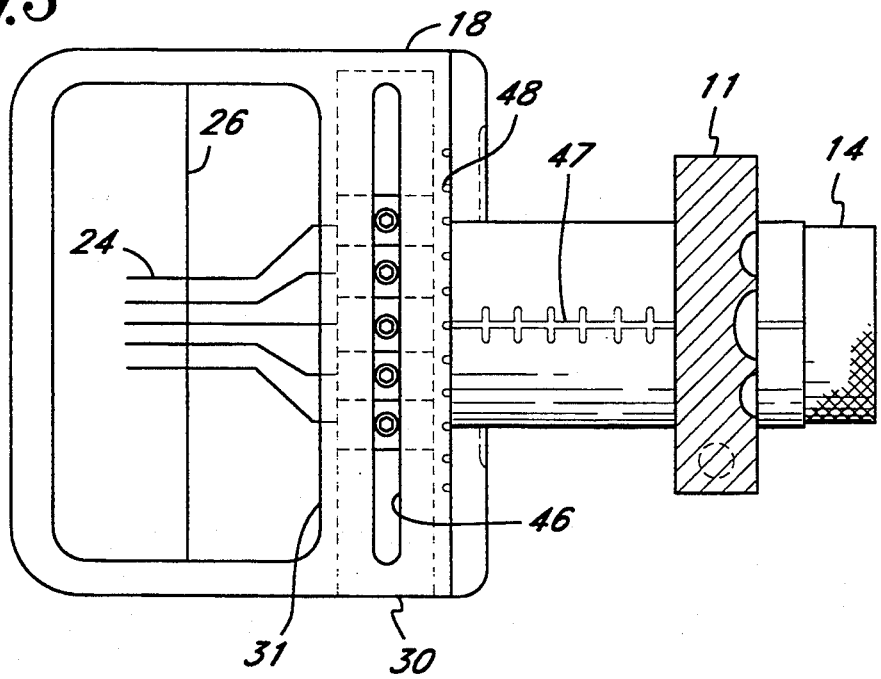
FIG. 5 is a view analogous to FIG. 3 except that it shows a crosshair setup of bowsight.

A dovetail slide attachment 16 has a dovetail bar 17 on an inner frame member 18 of reticle support frame 19. Reticle support frame 19 has a top frame member 20, an outer frame member 21 and a bottom frame member 22. These frame members protect a plurality of bowsight pins 23 (FIGS. 3 and 4) or wires 24 as shown in FIG. 5 which also includes a crosshair 26.

Figure 2:
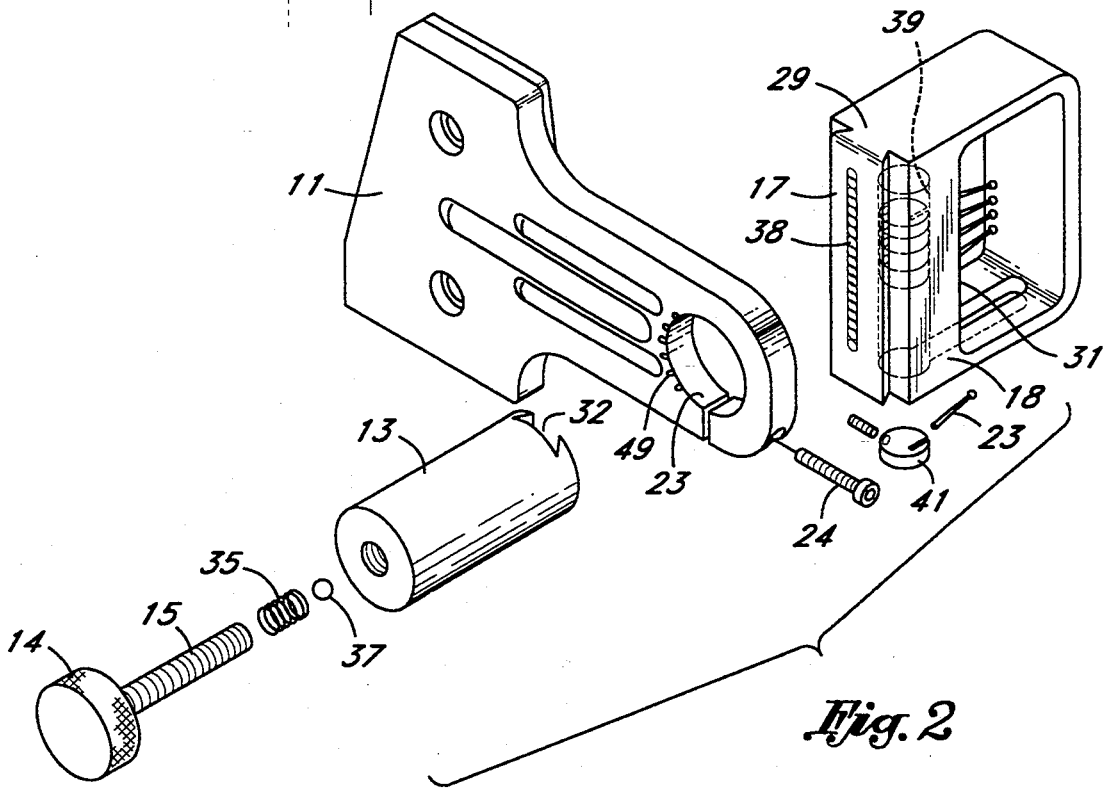
FIG. 2 is an exploded perspective view of the bowsight of FIG. 1.

The attachment of the reticle support frame assembly to bracket member 11 via bracket cross piece 13 is shown best in FIG. 2 where it can be seen that bracket member 11 has a circular clamp portion 50 which is tightened by screw 51 against the cylindrical bracket cross piece 13. This permits the reticle support frame 19 to be turned as indicated by arrow 25 or moved inwardly and outwardly as indicated by arrow 27'. It may also be moved upwardly and downwardly as shown by arrow 27 by the dovetail slide attachment 16.

Figure 6:
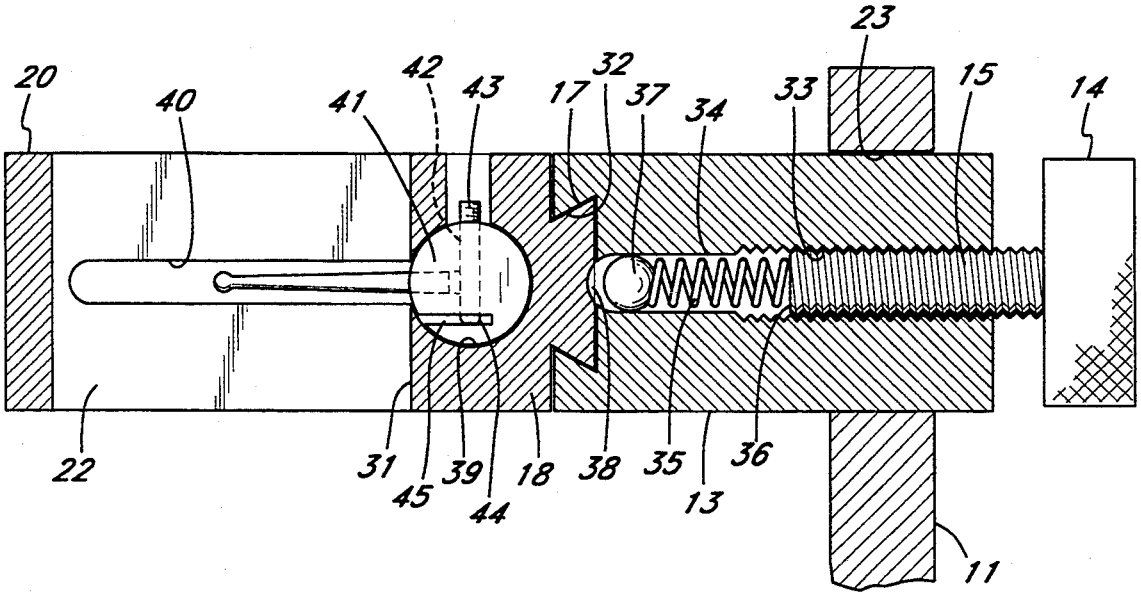
FIG. 6 is a cross-sectional view taken along 6—6 of FIG. 1.

Dovetail slide attachment utilizes a dovetail bar 17 attached to the inner edge 28 of inner frame member 18. Inner frame member 18 has a top 29, a bottom 30 and an outer edge 31 shown best in FIGS. 2, 3 and 4. Dovetail bar 17 fits in a sliding manner into dovetail slot 32 in bracket cross piece 13. The interior of bracket cross piece 13 is shown best in FIGS. 6 and 7. In FIG. 6 it can be seen that bracket cross piece 13 has a threaded opening 33 into which threaded rod 15 fits. A spring holding cylinder 34 holds a spring 35 which is contacted by the end 36 of threaded rod 15. The other end of spring 35 contacts a ball bearing 37 which may move in and out of a plurality of detents 38 shown best in FIG. 2. Although the number of detents is variable they should be close enough together so that the reticle support frame may be moved up and down in small increments. It should also be noted in FIGS. 6 and 7 that the spring holding cylinder 34 has a reduced end 34 to hold the ball bearing 37 in spring holding cylinder 34.

An interesting feature of this assembly is that spring 35 is selected so that it may be completely compressed (FIG. 7) by fully turning knurled knob 14 thereby forming an inelastic holding assembly holding ball bearing 37 in a selected detent 38 so that it will not be accidentally moved when bumped. Then in order to adjust the height of the frame, one merely loosens knurled knob 14 (FIG. 6) and the frame may be moved up and down in increments as ball bearing 37 moves in and out of the individual detents. This provides an incremental movement which is much easier to adjust than a smooth slide would be.

Another important feature of the present invention is the manner in which the bowsight pins 23 or wires 24 are adjustably held in the reticle support frame 19. As shown in FIGS. 2 through 7, inner frame member 18 has a cylindrical pin slide 39 which extends from the bottom 30 of inner frame member 18 to near the top 29. In addition, a pin slot 40 is formed through bottom frame member 22 which permits the insertion of a sliding pin block disc 41 with an attached bowsight pin 23 which is secured by an adhesive in a permanent manner to sliding pin block disc 41. A threaded Allen screw opening 42 shown best in FIGS. 6 and 7 holds an Allen screw 43. Allen screw 43 is screwed into the sliding pin block disc after it has been inserted in pin slide 39 since the Allen screw access slot 46 does not extend to the bottom 30 of inner frame member 18. Thus, more than one but typically five bowsight pins may be inserted into the bowsight and tightened at a desired position and separation. As is often the case, the individual sliding pin block discs 41 and bowsight pins 23 may be fabricated so that the bowsight pin is at a different angle with respect to the sliding block disc. This is shown best in FIG. 3 where it can be seen that bowsight pin 23*a* has a different angle with respect to its sliding pin block disc 41 than does any of the other bowsight pins 23*b*, 23*c*, 23*d* and 23*e*. Similarly, the wires 24 shown in FIG. 5 each have a different configuration so that they may be very close together for higher speed bows.

Figure 7:
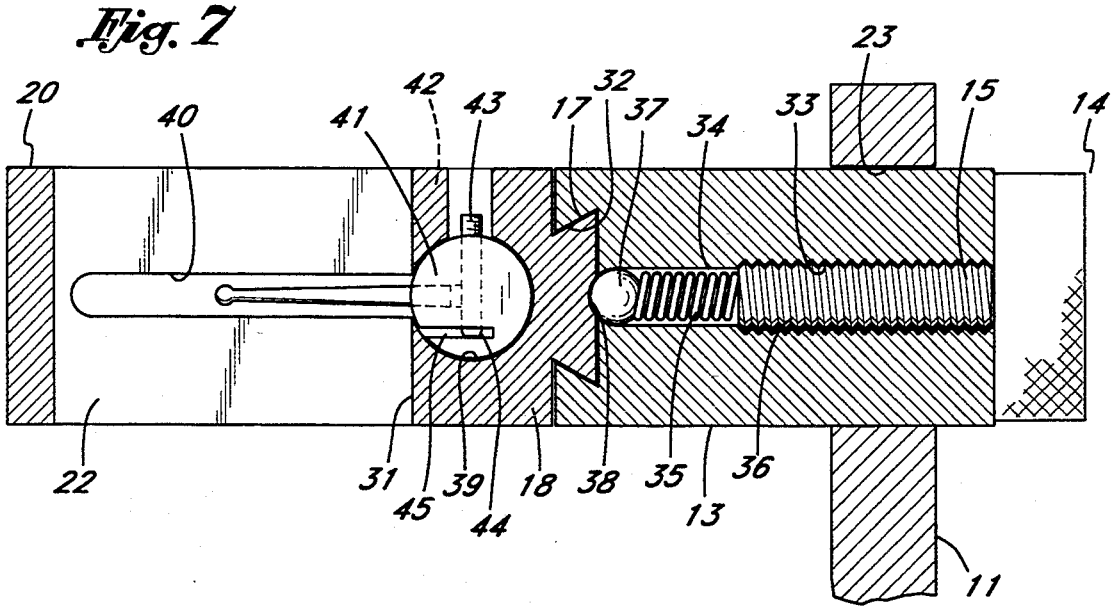
FIG. 7 is a cross-sectional view analogous to FIG. 6 except that it shows the dovetail attachment of the bowsight in a locked configuration.

The method of tightening an individual sliding pin disc 41 is shown best in FIGS. 6 and 7 where the bottom 44 of Allen screw 43 abuts the bottom of a slot 45 cut into sliding pin block disc 41. This expands the outer circumference of disc 41 against pin slide 39 and securely holds the disc in place. The holding is around such a large surface of disc 41 that it does not dent or mar the inner surface of pin slide 39, thus, permitting the numerous adjustments of individual sight pins without any tendency to fall into a previous position.

Another feature of the present bowsight assembly is its ability to be reassembled in a desired position. Thus, if the archer disassembles the sight, he can readily reposition it in a desired position. This is accomplished by several sets of indicia. One set of indicia 47 is formed along bracket cross piece 13 to position it as the assembly is moved back and forth in the direction of arrow 27 in FIG. 1. Thus, indicia 47 is read against bracket member 11. A set of vertical indicia 48 is formed along the inner edge 28 of inner frame member 18 as shown best in FIGS. 3 and 5 so that the position of the bowsight as it is moved in the direction of arrow 27 may be ascertained. A set of semi-circular indicia 49 can be used to determine angular position (FIG. 2).

The bowsight of the present invention is thus a very compact, durable and completely adjustable assembly which is not easily dislocated by the inadvertent contact of the bowsight with underbrush and the like. It provides the option of a pin setup or a crosshair setup and is very easily adjusted in small increments by the combination of the ball bearing 37 and the detents 38. It furthermore may be locked in a desired position against inadvertent movement.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A bowsight for attachment to a bow for improving the aim of the bow user comprising:

a bracket affixable to a bow;

a reticle support frame held by said bracket, said support frame having an inner frame member having an inner edge, a back side, a front side, a top, a bottom and an outer edge;

a pin slide comprising a vertical cylindrical opening formed in said inner frame member and extending from the bottom to near the top, which pin slide includes an elongated pin slot extending to said outer edge of said inner frame member and said pin slide further including an Allen screw access slot extending vertically along one of said sides; and a plurality of sliding pin block discs, each pin block disc supporting a bowsight pin extending generally axially therefrom and extending through said elongated pin slot, each pin block disc also having a threaded Allen screw opening extending to an Allen screw hole bottom part way through said disc and positioned to be accessible from said Allen screw access slot and an expansion slot formed at a right angle to said Allen screw slot below the Allen screw hole bottom, whereby a plurality of bowsight pins may be adjustably positioned along said inner frame member.

2. The bowsight of claim 1 wherein said reticle support frame is four sided and has a top frame member, an outer frame member and a bottom frame member.

3. The bowsight of claim 1 wherein said inner frame member is held to said bracket by a slide attachment allowing the reticle support frame to be adjustably raised and lowered wherein the slide assembly comprises;

a first slide member on said inner edge of said inner frame member, said first slide member having a vertical center having a plurality of detents; and a second slide member held on a bracket cross piece held by said bracket, said second slide member mating with said first slide member so that the reticle support frame may be moved up and down with respect to said bracket cross piece, said bracket cross piece having an opening threaded from an exterior end and extending through the bracket cross piece and including a ball bearing adjacent the plurality of detents, a helical spring adjacent the ball bearing and a threaded shaft with a shaft handle for tightening the ball against one of the detents but when loosened permitting the frame to be incrementally moved up and down.

4. The bowsight of claim 3 wherein the length of the spring is selected so that the spring will become completely collapsed to permanently hold the ball in the selected detent.

5. The bowsight of claim 3 wherein said slide assembly is a dovetail slide.

6. The bowsight of claim 3 wherein said bracket cross piece is cylindrical and held in a clamp on said bracket so that it may be turned and moved in and out to provide further adjustment for the reticle frame.

7. The bowsight of claim 6 wherein there are position indicating indicia on the bracket cross piece and on the inner frame member.

8. The bowsight of claim 3 wherein there are about 20 detents on said inner frame member.

9. A bowsight for attachment to a bow comprising:

a reticle support frame having an inner frame member which supports a plurality of spaced bowsight pins;

a bracket cross piece having a slidable dovetail connection to said inner frame member, said inner frame member having a plurality of detents formed therealong and said cross piece having an opening therealong, said opening being threaded from a remote end of the cross piece and having a threaded rod therein having an adjustment handle extending past the remote end of the cross piece and having an inner end which contacts a spring having a spring length which also contacts a ball bearing captured adjacent a frame end, said ball bearing and said detents being positioned so that the ball bearing rides in and out of the detents and the spring length being selected so that when the threaded rod is tightened, the spring is completely collapsed so that the reticle frame cannot move with respect to the bracket cross piece; and a bracket adjustably affixed to the cross piece and said bracket being affixable to a bow.

10. The bowsight of claim 9 wherein said bracket cross piece has an indicia marked therealong terminating at the inner frame member and the inner frame member has vertical indicia positioned so that the vertical position of the inner frame member may be ascertained with respect to the cross piece and the position of the cross piece with respect to the bracket may be ascertained.

* * * * *